US011297418B2

(12) United States Patent
Koizumi et al.

(10) Patent No.: US 11,297,418 B2
(45) Date of Patent: Apr. 5, 2022

(54) ACOUSTIC SIGNAL SEPARATION APPARATUS, LEARNING APPARATUS, METHOD, AND PROGRAM THEREOF

(71) Applicant: NIPPON TELEGRAPH AND TELEPHONE CORPORATION, Tokyo (JP)

(72) Inventors: Yuma Koizumi, Tokyo (JP); Sakurako Yazawa, Tokyo (JP); Kazunori Kobayashi, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 15/734,473

(22) PCT Filed: May 20, 2019

(86) PCT No.: PCT/JP2019/019833
§ 371 (c)(1),
(2) Date: Dec. 2, 2020

(87) PCT Pub. No.: WO2019/235194
PCT Pub. Date: Dec. 12, 2019

(65) Prior Publication Data

US 2021/0219048 A1 Jul. 15, 2021

(30) Foreign Application Priority Data

Jun. 7, 2018 (JP) ..... JP2018-109327

(51) Int. Cl.
*H04R 1/40* (2006.01)
*H04R 3/00* (2006.01)
(Continued)

(52) U.S. Cl.
CPC ..... *H04R 1/406* (2013.01); *H04R 3/005* (2013.01); *H04R 5/027* (2013.01); *H04R 29/005* (2013.01);
(Continued)

(58) Field of Classification Search
CPC ..... H04R 1/406; H04R 3/005; H04R 5/027; H04R 29/005; H04R 2201/401; H04R 2430/20
(Continued)

(56) References Cited

U.S. PATENT DOCUMENTS 8,577,055 B2 * 11/2013 Jeong ..... H04R 3/005 381/92
8,737,636 B2 * 5/2014 Park ..... G10K 11/17817 381/71.8
(Continued)

FOREIGN PATENT DOCUMENTS

JP 2009-128906 A 6/2009
JP 2015-164267 A 9/2015

OTHER PUBLICATIONS

Yuma Koizumi (2017) "A Research on the Design of Statistical Objective Functions for Estimating Acoustic Information using Deep Learning" Doctoral Thesis Application, Graduate School of Information Science and Technology, The University of Electro-Communications, 162 pages.

*Primary Examiner* — Disler Paul

(57) ABSTRACT

An acoustic signal is separated based on a difference in the distance from a sound source to a microphone. By using a filter obtained by associating a value corresponding to an estimated value of a short-distance acoustic signal which is obtained by using "a predetermined function" from a second acoustic signal derived from signals collected by "a plurality of microphones" and is emitted from a position close to "the plurality of microphones" with a value corresponding to an estimated value of a long-distance acoustic signal which is emitted from a position far from "the plurality of microphones", a desired acoustic signal representing at least one of a sound emitted from a position close to "a specific microphone" and a sound emitted from a position far from "the specific microphone" is acquired from a first acoustic signal derived from a signal collected by "the specific microphone". Note that "the predetermined function" is a function which uses such an approximation that a sound
(Continued)

emitted from the position close to "the plurality of microphones" is collected as a spherical wave, and a sound emitted from the position far from "the plurality of microphones" is collected as a plane wave.

19 Claims, 5 Drawing Sheets

(51) Int. Cl.
*H04R 5/027* (2006.01)
*H04R 29/00* (2006.01)
*H04S 7/00* (2006.01)

(52) U.S. Cl.
CPC ..... *H04S 7/301* (2013.01); *H04R 2201/401* (2013.01); *H04R 2430/20* (2013.01)

(58) Field of Classification Search
USPC ..... 381/26, 94.1–94.9, 91–92, 66
See application file for complete search history.

(56) References Cited

U.S. PATENT DOCUMENTS

| | | | | |
|---|---|---|---|---|
| 10,210,882 | B1 * | 2/2019 | McCowan ..... | H04R 1/406 |
| 10,433,086 | B1 * | 10/2019 | Juszkiewicz ..... | H04R 3/005 |
| 2008/0175408 | A1 * | 7/2008 | Mukund ..... | G10L 21/0208 381/94.1 |
| 2009/0132245 | A1 | 5/2009 | Wilson et al. | |

* cited by examiner

ACOUSTIC SIGNAL SEPARATION APPARATUS, LEARNING APPARATUS, METHOD, AND PROGRAM THEREOF

CROSS-REFERENCE TO RELATED APPLICATIONS

This application is a U.S. 371 Application of International Patent Application No. PCT/JP2019/019833, filed on 20 May 2019, which application claims priority to and the benefit of JP Application No. 2018-109327, filed on 7 Jun. 2018, the disclosures of which are hereby incorporated herein by reference in their entireties.

TECHNICAL FIELD

The present invention relates to a technique for separating an acoustic signal, and particularly relates to a technique for separating an acoustic signal based on a difference in the distance from a sound source to a microphone.

BACKGROUND ART

Acoustic signal separation is a method for separating an acoustic signal based on a difference in some signal characteristic between a target sound and noise. A typical acoustic signal separation method includes a method in which separation is performed based on a difference in tone quality (DNN (Deep Neural Network) sound source enhancement or the like) (see, e.g., NPL 1 or the like), and a method in which separation is performed based on a difference in the direction of a sound (an intelligent microphone or the like).

CITATION LIST

Non Patent Literature

[NPL 1] Yuma Koizumi, "A Research on the Design of Statistical Objective Functions for Estimating Acoustic Information using Deep Learning", The University of Electro-Communications, Graduate school of Informatics and Engineering, September 2017

SUMMARY OF THE INVENTION

Technical Problem

In order to separate the acoustic signal based on the difference in the distance from the sound source to the microphone, it is necessary to obtain "spatial information" of a sound field elaborately. In order to obtain the spatial information, a large number of microphones are usually required. In this case, as in the conventional DNN sound source enhancement, when an acoustic feature value of an observed signal obtained by each microphone is used as learning data of DNN without being altered, the amount of learning data and the amount of learning time become enormous, and it becomes difficult to perform the separation of the acoustic signal. Although a plan that the acoustic feature value is devised can be adopted, most of the conventional acoustic feature values are related to tone quality such as MFCC (mel-frequency-cepstrum-coefficient) and log-mel-spectrum, or are related to a direction of an output sound of a beamformer and the like, and the acoustic feature value to be used for separating the acoustic signal based on the difference in the distance from the sound source to the microphone is still unknown.

The present invention is achieved in view of such a point, and an object thereof is to separate an acoustic signal based on a difference in the distance from a sound source to a microphone.

Means for Solving the Problem

A value corresponding to an estimated value of a short-distance acoustic signal is associated with a value corresponding to an estimated value of a long-distance acoustic signal, to obtain a filter. The value corresponding to an estimated value of a short-distance acoustic signal and the value corresponding to an estimated value of a long-distance acoustic signal are obtained from a second acoustic signal, which is derived from signals collected by "the plurality of microphones", using "a predetermined function". The short-distance acoustic signal means a signal emitted from a position close to "the plurality of microphones" and the long-distance acoustic signal means a signal emitted from a position far from "the plurality of microphones. By using this filter, a desired acoustic signal representing at least one of a sound emitted from a position close to "a specific microphone" and a sound emitted from a position far from "the specific microphone" is acquired from a first acoustic signal derived from a signal collected by "the specific microphone". Note that "the predetermined function" is a function which uses such an approximation that a sound emitted from the position close to "the plurality of microphones" is collected by "the plurality of microphones" as a spherical wave, and a sound emitted from the position far from "the plurality of microphones" is collected by "the plurality of microphones" as a plane wave.

Effects of the Invention

By using the filter obtained by associating the value corresponding to the estimated value of the short-distance acoustic signal with the value corresponding to the estimated value of the long-distance acoustic signal, it becomes possible to separate the acoustic signal based on the difference in the distance from the sound source to the microphone.

DESCRIPTION OF EMBODIMENTS

Figure 1:
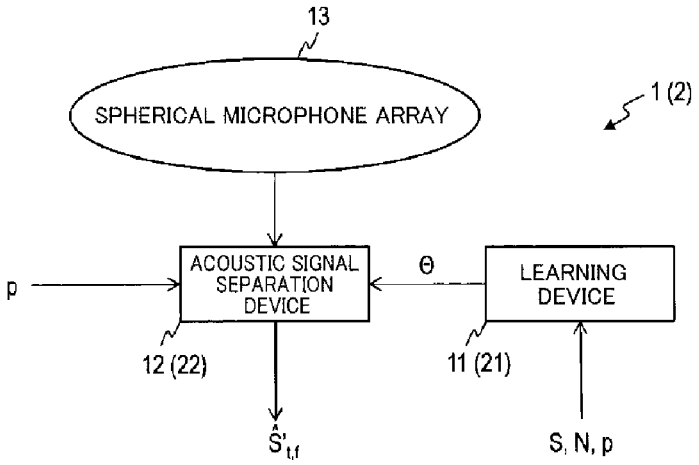
FIG. 1 is a block diagram illustrating the functional configuration of an acoustic signal separation system of an embodiment.

Hereinbelow, embodiments of the present invention will be described with reference to the drawings.

[Principle]

First, a principle will be described.

In the embodiment described below, from signals collected by M+1 microphones, at least one of a sound source positioned near the microphones (near sound source) and a sound source positioned far from the microphones (distant sound source) is separated. Note that the distance from each microphone to each near sound source is shorter than the distance from each microphone to each distant sound source. For example, the distance from each microphone to each near sound source is not more than 30 cm, and the distance from each microphone to each distant sound source is not less than 1 m. Note that M is an integer of not less than 1, and is preferably an integer of not less than 2. An observed signal in a time-frequency domain in a time interval t at a frequency f, which is obtained by sampling an observed signal in a time domain collected by the $m \in \{0, \ldots, M\}$-th microphone and further converting the observed signal to the observed signal in the time-frequency domain, is given by $$X_{t,f}^{(m)} \quad \text{[Formula 1]}$$

and is defined as follows:

$$X_{t,f}^{(m)} = S_{t,f}^{(m)} + N_{t,f}^{(m)} \quad (1) \quad \text{[Formula 2]}$$

where $$S_{t,f}^{(m)} \quad \text{[Formula 3]}$$

is a component corresponding to a short-distance acoustic signal in the time-frequency domain in the time interval t at the frequency f which is obtained by sampling a short-distance acoustic signal obtained by collecting a near sound emitted from the near sound source with the m-th microphone and further converting the short-distance acoustic signal to the short-distance acoustic signal in the time-frequency domain.

$$N_{t,f}^{(m)} \quad \text{[Formula 4]}$$

is a component corresponding to a long-distance acoustic signal in the time-frequency domain in the time interval t at the frequency f which is obtained by sampling a long-distance acoustic signal obtained by collecting a distant sound emitted from the distant sound source with the m-th microphone and further converting the long-distance acoustic signal to the long-distance acoustic signal in the time-frequency domain. $t \in \{1, \ldots, T\}$ and $f \in \{1, \ldots, F\}$ are indexes of the time interval (frame) and the frequency (discrete frequency) in the time-frequency domain. Each of T and F is a positive integer, the time interval corresponding to the index t is written as "a time interval t", and the frequency corresponding to the index f is written as "a frequency f". Due to restriction of description and notation, in the following description, in some cases, $$X_{t,f}^{(m)}, S_{t,f}^{(m)}, N_{t,f}^{(m)} \quad \text{[Formula 5]}$$

are written as $X_{t,f}^{(m)}$, $S_{t,f}^{(m)}$, and $N_{t,f}^{(m)}$. Although the detailed description thereof will be omitted, $S_{t,f}^{(m)}$ is dependent on each transmission characteristic from an original signal of each near sound source to the m-th microphone from the near sound source, and $N_{t,f}^{(m)}$ is dependent on each transmission characteristic form an original signal of each distant sound source to the m-th microphone from the distant sound source. The conversion to the time-frequency domain can be performed by, e.g., the fast Fourier transform (FFT) or the like.

<Near Sound Extraction by Internal Sound Field Prediction Based on Spherical Harmonic Expansion>

First, a description will be given of a near sound collection method which uses a spherical microphone array including a microphone disposed at the center of a sphere and M microphones disposed at regular intervals on the spherical surface of the sphere. Suppose that, among the above-mentioned M+1 microphones, the 0-th microphone is disposed at the center of the sphere, and the other first to M-th microphones are disposed at regular intervals on the spherical surface of the sphere. In this method, attention is focused on such an approximation that the sound wave of a distant sound comes to the microphone as a plane wave, and the sound wave of a near sound comes to the microphone as a spherical wave. In the case where only a sound which comes from the outside of a spherical surface having a radius r (r is a positive value) is present, it is possible to predict a sound pressure on the spherical surface having a radius r0 (r0<r) from a spherical harmonic spectrum (spherical harmonic expansion coefficient) of a sound pressure distribution observed on the spherical surface. Herein, the sound pressure at the center of the sphere is predicted by using observed signals at the first to M-th microphones disposed on the spherical surface, and a difference between the predicted sound pressure at the center of the sphere and the sound pressure observed by the microphone disposed at the center of the sphere is obtained. The distant sound has excellent approximation accuracy as the plane wave, and hence the difference approaches 0. On the other hand, in the case of the near sound, plane wave approximation is difficult, and hence the near sound corresponds to the difference as an approximation error. As a result, near sound source enhancement (i.e., to separate an estimated value of a short-distance acoustic signal emitted from a position close to the microphone from the observed signal) is implemented. This processing can be written as follows (see, e.g., Reference 1 or the like):

[Formula 6]

$$\hat{S}_{t,f,D} = X_{t,f,D}^{(0)} - \sum_{m'=1}^{M} \frac{1}{J_0(kr)} \frac{1}{M} X_{t,f,D}^{(m')} \quad (2)$$

wherein $J_0(kr)$ is a spherical Bessel function, and k is a wave number corresponding to a frequency f. The left side of Formula 2 represents the estimated value of the short-distance acoustic signal and, due to restriction of description and notation, in some cases, this is written as $\hat{S}_{t,f,D}$ in the following description. Similarly, in some cases, $$X_{t,f,D}^{(m)} \quad \text{[Formula 7]}$$

is written as $X_{t,f,D}^{(m)}$. D, which is a subscript, represents a down-sampled signal. That is, $\hat{S}_{t,f,D}$ is obtained by down-sampling $\hat{S}_{t,f}$, and $X_{t,f,D}^{(m)}$ is obtained by down-sampling $X_{t,f}^{(m)}$.

[Reference 1] Haneda Yoichi, Furuya Ken'ichi, Koyama Shoichi, Niwa Kenta, "Kyumen Chowa Kansu Tenkai ni Motozuku 2-Syurui no Cho-setsuwa Maikurohon Arei" (Two Types of Super Close-Talking Microphone Arrays Based on Spherical Harmonic Expansion), IEICE Transactions A, Vol. J97-A, No. 4, pp. 264-273, 2014.

The estimated value $\hat{S}_{t,f,D}$ of the short-distance acoustic signal obtained by Formula (2) is a down-sampled signal. This is because the maximum frequency of the acoustic signal which can be separated by the above-described method is dependent on the radius r of the spherical microphone array. For example, in the case where the spherical microphone array having a radius r=5 (cm) is used, a forbidden frequency called "spherical Bessel zero" is present in the vicinity of 3.4 kHz. Accordingly, the observed signal has to be down-sampled to its Nyquist frequency or less before separation, or an algorithm has to be designed such that only the frequency of not more than the forbidden frequency is processed. On the other hand, in an application which handles the acoustic signal in voice recognition or the like, a signal in a frequency band equal to or higher than 4 kHz is used. Therefore, it is not possible to use the above method as preprocessing of such an application without altering the method.

<Estimation of Time-Frequency Mask which Uses Deep Learning>

Next, a description will be given of time-frequency mask processing serving as another sound source separation method. In the time-frequency mask processing, the estimated value $\hat{S}_{t,f}$ of a target signal is obtained from the acoustic signal $X_{t,f}$ by the following formula:

$$\hat{S}_{t,f}=G_{t,f}X_{t,f} \quad (3) \qquad \text{[Formula 8]}$$

wherein $G_{t,f}$ is the time-frequency mask. In addition, due to restriction of description and notation, the left side of Formula (3) is written as $\hat{S}_{t,f}$. In the case where the target signal is the short-distance acoustic signal included in the acoustic signal $X_{t,f}$ and a noise signal is the long-distance acoustic signal, $G_{t,f}$ is obtained, e.g., as follows:

[Formula 9]

$$G_{t,f} = \frac{|S_{t,f}^{(0)}|}{|S_{t,f}^{(0)}| + |N_{t,f}^{(0)}|} \quad (4)$$

That is, when the short-distance acoustic signal $S_{t,f}^{(0)}$ and the long-distance acoustic signal $N_{t,f}^{(0)}$ are known, the time-frequency mask $G_{t,f}$ is easily obtained. However, in general, the short-distance acoustic signal $S_{t,f}^{(0)}$ and the long-distance acoustic signal $N_{t,f}^{(0)}$ are unknown, and the time-frequency mask $G_{t,f}$ has to be estimated in some way. In DL (deep learning) sound source enhancement which uses DNN (Deep Neural Network) (also referred to as "DNN sound source enhancement"), a vector $G_t=(G_{t,1}, \ldots, G_{t,F})$ obtained by vertically arranging time-frequency masks $G_{t,1}, \ldots, G_{t,F}$ at individual frequencies $f \in \{1, \ldots, F\}$ in the time interval t is estimated as follows (see, e.g., Reference 2 or the like):

$$G_t=M(\phi_t|\theta) \quad (5) \qquad \text{[Formula 10]}$$

wherein M is a regression function which uses a neural network, $\phi_t$ is an acoustic feature value in the time interval t which is extracted from the observed signal, θ is a parameter of the neural network, and $\bullet^T$ represents transposition of •. In addition, $0 \leq G_{t,f} \leq 1$ is satisfied.

[Reference 2] H. Erdogan, J. R. Hershey, S. Watanabe, and J. L. Roux, "Phase-sensitive and recognition-boosted speech separation using deep recurrent neural networks," in Proc. ICASSP, 2015.

In order to estimate $G_t$ in the DL sound source enhancement elaborately, it is necessary to use the acoustic feature value $\phi_t$ having a large mutual information amount with $G_t$ (see, e.g., Reference 3 or the like). In other words, the acoustic feature value $\phi_t$ needs to include a clue (information) for distinguishing between the short-distance acoustic signal and the long-distance acoustic signal.

[Document 3] Y. Koizumi, K. Niwa, Y. Hioka, K. Kobayashi and H. Ohmuro, "Informative acoustic feature selection to maximize mutual information for collecting target sources", IEEE/ACM Trans. Audio, Speech and Language Processing, PP. 768-779, 2017.

As described above, the short-distance acoustic signal corresponds to the original signal emitted from the near sound source, the long-distance acoustic signal corresponds to the original signal emitted from the distant sound source, and the distance from the microphone to the near sound source is different from the distance from the microphone to the distant sound source. Consequently, as the acoustic feature value $\phi_t$, the acoustic feature value representing the distance from the sound source to the microphone or the spatial feature of the sound field should be used. However, MFCC (mel-frequency-cepstrum-coefficient) or log-mel-spectrum, which is widely used in the DL sound source enhancement, is the feature value related to tone quality, and the feature value lacks the distance from the sound source to the microphone and the spatial information of the sound field. In addition, the spatial feature value significantly changes depending on the reverberations or shape of a room, and hence it has been difficult to use the spatial feature value as the acoustic feature value for the DL sound source enhancement. Accordingly, it has been difficult to implement near/distant sound source separation in which at least one of the short-distance acoustic signal and the long-distance acoustic signal is separated from the observed signal based on the DL sound source enhancement.

Method of Present Embodiment

In contrast to this, in the embodiment described below, the time-frequency mask which implements the near/distant sound source separation is estimated with deep learning by using the acoustic feature value obtained by spherical harmonic analysis. With this method, (1) it becomes possible to implement the near/distant sound source separation even in a high frequency band in which the near/distant sound source separation cannot be implemented in the spherical harmonic analysis. This is because, although only the acoustic feature value in a low frequency band can be used in learning of the time-frequency mask, it is possible to use the time-frequency mask obtained by the learning in a high frequency band. In addition, (2) By using the acoustic feature value obtained by the spherical harmonic analysis, it is possible to estimate the time-frequency mask allowing the near/distant sound source separation which has been difficult to implement in the DL sound source enhancement. The detailed description thereof will be given below.

It is known that, in deep learning, it is possible to input the observed signal to the neural network as the feature value without altering the observed signal (see, e.g., Reference 4 or the like).

[Reference 4] Q. V. Le, K. Chen, G. S. Corrado, J. Dean, and A. Y. Ng, "Building High-level Features Using Large Scale Unsupervised Learning," in Proc. of ICML, 2012.

Therefore, it is intuitively conceivable to use a method in which the signal collected by the above-described spherical microphone array is directly input to the neural network as the acoustic feature value. However, realistically, it is difficult to use this method because of the following reasons. In most cases, the number of microphones M+1 of the spherical microphone array is larger than the number of microphones of a typical microphone array (for example, in Reference 1, 33 microphones are used). In sound source enhancement which uses deep learning, the acoustic feature value is often obtained by combining amplitude spectra of about five preceding frames and five subsequent frames (see, e.g., Reference 2 or the like). Accordingly, in the case where the observed signals obtained by 33 microphones are sampled, the observed signals in the time-frequency domain are obtained by using the fast Fourier transform (FFT) of 512 points, and the observed signals in the time-frequency domain are used as the input to the neural network without being altered, the number of dimensions of the input is 257 [points]×(1+5+5) [frames]×33 [channels]=93291 [dimensions] (6), which is enormous. In general, when the number of dimensions of the input to the neural network increases, enormous learning data and an enormous amount of calculation time are required in order to avoid overfitting. Therefore, in order to implement the near/distant sound source separation, the acoustic feature value which has the large mutual information amount with the above $G_t$ and the number of dimensions of the input which is as small as possible should be used. Accordingly, it is conceivable to use the estimated value $\hat{S}_{t,f,D}$ of the short-distance acoustic signal obtained by the spherical harmonic analysis of Formula (2) as the acoustic feature value. This is because a component corresponding to the distant sound is reduced and a component corresponding to the near sound is enhanced in $\hat{S}_{t,f,D}$ obtained by Formula (2), and $\hat{S}_{t,f,D}$ is expected to include the clue for distinguishing between the short-distance acoustic signal and the long-distance acoustic signal. However, $\hat{S}_{t,f,D}$ includes a component (residual noise of the distant sound) corresponding to the distant sound which is not erased by Formula (2), and the neural network may erroneously determine that the residual noise of the distant sound is the component corresponding to the near sound.

To cope with this, an estimated value $\hat{N}_{t,f,D}$ of the long-distance acoustic signal corresponding to the distant sound is also calculated by the following method:

[Formula 11]

$$\hat{N}_{t,f,D} = \frac{|X^{(0)}_{t,f,D}| - |\hat{S}_{t,f,D}|}{|X^{(0)}_{t,f,D}|} \cdot X^{(0)}_{t,f,D} \tag{7}$$

wherein |•| represents the absolute value of •. Further, an acoustic feature value $\phi_t$ obtained by associating a value corresponding to the estimated value $\hat{S}_{t,f,D}$ of the short-distance acoustic signal obtained by Formula (2) with a value corresponding to the estimated value $\hat{N}_{t,f,D}$ of the long-distance acoustic signal obtained by Formula (7) is calculated.

$$\varphi_t = (\hat{s}_{t-C,D}, \hat{n}_{1-C,D}, \ldots, \hat{s}_{t+C,D}, \hat{n}_{t+C,D})^T \quad (8)$$ [Formula 12]

where $$\hat{s}_{t,D} = \ln(Mel[\mathrm{Abs}[(\hat{S}_{t,1,D}, \hat{S}_{t,2,D}, \ldots, \hat{S}_{t,F,D})]]) \quad (9)$$ [Formula 13]

$$\hat{n}_{t,D} = \ln(Mel[\mathrm{Abs}[(\hat{N}_{t,1,D}, \hat{N}_{t,2,D}, \ldots, \hat{N}_{t,F,D})]]) \quad (10)$$ [Formula 14]

wherein C is a positive integer representing a context window length and, e.g., C=5 is satisfied. Abs[(•)] represents an operation for replacing each element of a vector (•) with the absolute value of each element. That is, the operation result of Abs[(•)] is a vector which has the absolute value of each element of the vector (•) as its element. Mel[(•)] represents an operation for obtaining a B-dimensional vector by multiplying the vector (•) by a Mel conversion matrix. That is, the operation result of Mel[(•)] is the B-dimensional vector corresponding to the vector (•). B=64 is satisfied. ln(•) represents an operation for replacing each element of the vector (•) with the natural logarithm of the element. That is, the operation result of ln(•) is a vector which has the natural logarithm of each element of the vector (•) as its element. In addition, due to restriction of description and notation, there are cases where the left side of Formula (9) is written as $\hat{s}_{t,D}$, and the left side of Formula (10) is written as $\hat{n}_{t,D}$.

In addition, the acoustic feature value $\phi_t$ may also be obtained by the following procedure:

1. By using $X_{t,f,D}^{(m)}$ ($m \in \{0, \ldots, M\}$) obtained by down-sampling the observed signal $X_{t,f}^{(m)}$ having a sampling frequency sf1 (first frequency) to the observed signal having a sampling frequency sf2 (second frequency), each of $\hat{S}_{t,f,D}$ and $\hat{N}_{t,f,D}$, which is down-sampled so as to have the sampling frequency sf2, is calculated according to Formulas (2) and (7). Note that sf2<sf1 is satisfied.
2. $\hat{S}_{t,f,D}$ and $\hat{N}_{t,f,D}$ are up-sampled to $\hat{S}_{t,f}$ and $\hat{N}_{t,f}$ each having the sampling frequency sf1.
3. In up-sampled states, by using $\hat{S}_{t,f}$ and $\hat{N}_{t,f}$ instead of $\hat{S}_{t,f,D}$ and $\hat{N}_{t,f,D}$, $\hat{s}_t$ and $\hat{n}_t$ are calculated instead of $\hat{s}_{t,D}$ and $\hat{n}_{t,D}$ according to Formulas (9) and (10). Further, $\hat{s}_{t,L}$ is obtained by extracting only an element in a frequency band equal to or lower than the Nyquist frequency from $\hat{s}_t$, and $\hat{n}_{t,L}$ is obtained by extracting only an element in a frequency band equal to or lower than the Nyquist frequency from $\hat{n}_t$.
4. The acoustic feature value $\phi_t$ is calculated according to Formula (8) by using $\hat{s}_{t,L}$ and $\hat{n}_{t,L}$ instead of $\hat{s}_{t,D}$ and $\hat{n}_{t,D}$.

In this case, in the case where the sampling frequency sf1 after up-sampling is 16 kHz, the number of dimensions of the acoustic feature value $\phi_t$ is as follows:

40[points]×(1+5+5)[frames]×2[2channels consisting of near and distant channels]=880[dimensions] (11)

As described above, in the case where the observed signal is used as the input to the neural network without being altered, the number of dimensions of the acoustic feature value corresponds to the number of microphones M+1 channels (33 channels in the example of Formula (6)), and the number of dimensions thereof has an extremely large value (93291 dimensions in the example of Formula (6)). In contrast to this, the number of dimensions of the acoustic feature value $\phi_t$ obtained by associating the value corresponding to the estimated value $\hat{S}_{t,f,D}$ of the short-distance acoustic signal with the value corresponding to the estimated value of the long-distance acoustic signal $\hat{N}_{t,f,D}$ as shown in Formula (8) corresponds to two channels consisting of $\hat{S}_{t,f,D}$ and $\hat{N}_{t,f,D}$ irrespective of the number of microphones M+1, and has a relatively small value (880 dimensions in the example of Formula (11)). For example, when Formula (6) is compared with Formula (11), the number of dimensions of the acoustic feature value $\phi_t$ of Formula (8) is reduced to 1/100 or less as compared with the case where the observed signal is used as the input to the neural network without being altered.

The parameter θ of the above-described Formula (5) is learned by using the acoustic feature value $\phi_t$ obtained in the above manner as learning data. For example, by using the given short-distance acoustic signal $S_{t,f}^{(0)}$, the given observed signal $X_{t,f}^{(0)}$, and the acoustic feature value $\phi_t$ obtained from the observed signal $X_{t,f}^{(m)}$ as learning data, the parameter θ which minimizes the following function value J(θ) is learned.

[Formula 15]

$$J(\Theta) = \sum_{t=1}^{T} \|S_t^{(0)} - M(\varphi_t \mid \Theta) \circ X_t^{(0)}\|_2 \tag{12}$$

where

[Formula 16]

$$S_t^{(0)} = (S_{t,1}^{(0)}, \ldots, S_{t,F}^{(0)})^T \tag{13}$$

-continued

[Formula 17]

$$X_t^{(0)} = (X_{t,1}^{(0)}, \ldots, X_{t,F}^{(0)})^T \tag{14}$$

$\alpha O \beta$ represents an operation (multiplication for each element) for obtaining a vector which has an element obtained by multiplying an element of a vector $\alpha$ and an element of a vector $\beta$ which are at the same positions together as its element. That is, when $\alpha=(\alpha_1, \ldots, \alpha_F)^T$ and $\beta=(\beta_1, \ldots, \beta_F)^T$ are satisfied, $\alpha O \beta=(\alpha_1\beta_1, \ldots, \alpha_F\beta_F)^T$ is satisfied. In addition, $\|\alpha\|_q$ is a $L_q$ norm.

By using the parameter $\theta$ obtained in the above manner, it becomes possible to perform acoustic signal separation on $X_{t,f}^{(m)}$ ($m \in \{0, \ldots, M\}$) which is newly obtained by being subjected to collection with M+1 microphones, sampling, and conversion to the time-frequency domain. That is, by using the parameter $\theta$ and the acoustic feature value $\phi_t$ calculated from newly obtained $X_{t,f}^{(m)}$, $G_t=(G_{t,1}, \ldots, G_{t,F})^T$ is obtained according to Formula (5), and $\hat{S}_{t,f}$ can be calculated according to Formula (3).

First Embodiment

A first embodiment will be described.

<Configuration>

As illustrated in FIG. 1, an acoustic signal separation system 1 of the present embodiment has a learning device 11, an acoustic signal separation device 12, and a spherical microphone array 13.

«Learning Device 11»

Figure 2:
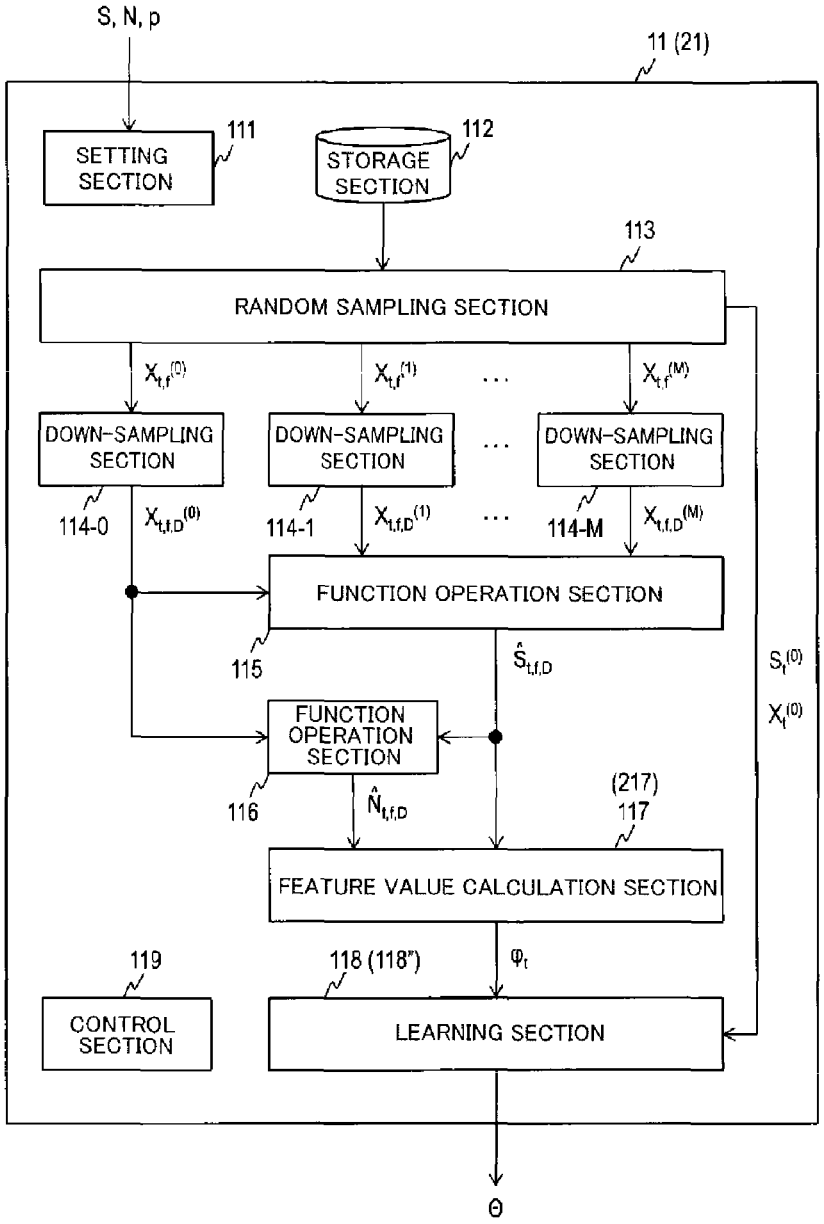
FIG. 2 is a block diagram illustrating the functional configuration of a learning device of the embodiment.

As illustrated in FIG. 2, the learning device 11 of the present embodiment has a setting section 111, a storage section 112, a random sampling section 113, down-sampling sections 114-*m* ($m \in \{0, \ldots, M\}$), function operation sections 115 and 116, a feature value calculation section 117, a learning section 118, and a control section 119.

«Acoustic Signal Separation Device 12»

Figure 3:
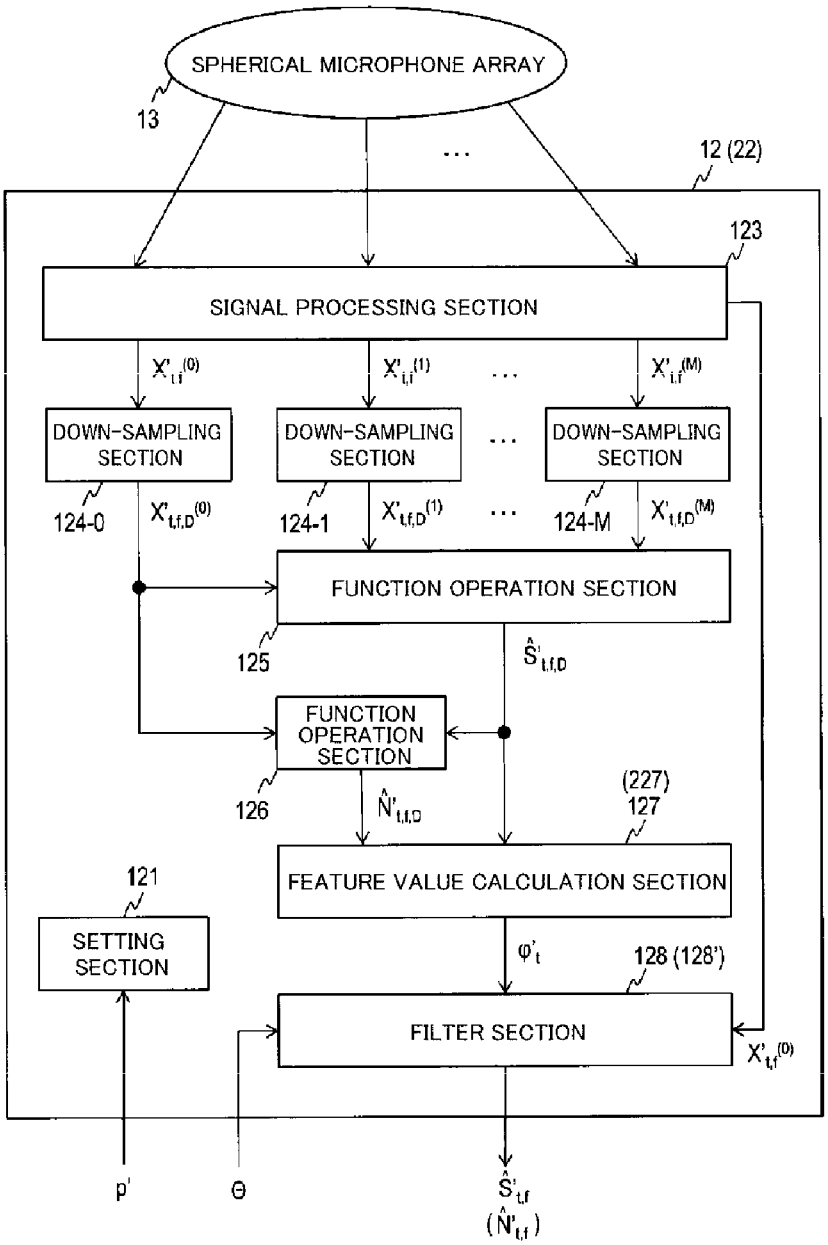
FIG. 3 is a block diagram illustrating the functional configuration of an acoustic signal separation device of the embodiment.

As illustrated in FIG. 3, the acoustic signal separation device 12 of the present embodiment has a setting section 121, a signal processing section 123, down-sampling sections 124-*m* ($m \in \{0, \ldots, M\}$), function operation sections 125 and 126, a feature value calculation section 127, and a filter section 128.

«Spherical Microphone Array 13»

The spherical microphone array 13 has the 0-th microphone disposed at the center of a sphere having a radius r, and the first to M-th microphones disposed at regular intervals on the spherical surface of the sphere.

<Learning Processing>

Figure 4:
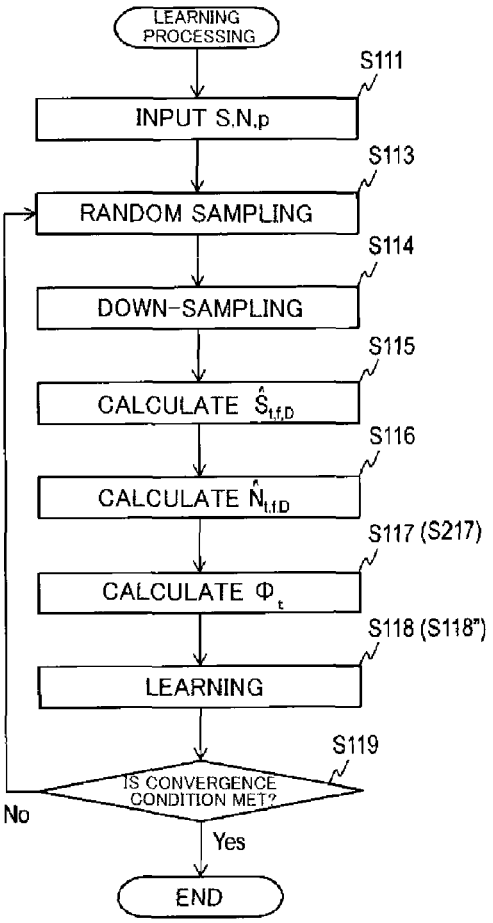
FIG. 4 is a flowchart for explaining learning processing of the embodiment.

Next, by using FIG. 4, learning processing of the present embodiment will be described.

As preprocessing, the short-distance acoustic signal obtained by collecting the near sound emitted from a single or a plurality of any near sound sources with M+1 microphones of the spherical microphone array 13 is sampled with the sampling frequency sf1 and the short-distance acoustic signal is converted to the short-distance acoustic signal in the time-frequency domain, and the short-distance acoustic signal $S_{t,f}^{(m)}$ ($m \in \{0, \ldots, M\}$) in the time-frequency domain is thereby obtained. A plurality of $S_{t,f}^{(m)}$ are acquired while the near sound source is randomly selected, and the set S consisting of the plurality of $S_{t,f}^{(m)}$ is obtained. Similarly, the long-distance acoustic signal obtained by collecting the distant sound emitted from a single or a plurality of any distant sound sources with M+1 microphones of the spherical microphone array 13 is sampled with the sampling frequency sf1 and the long-distance acoustic signal is converted to the long-distance acoustic signal in the time-frequency domain, and the long-distance acoustic signal $N_{t,f}^{(m)}$ ($m \in \{0, \ldots, M\}$) in the time-frequency domain is thereby obtained. A plurality of $N_{t,f}^{(m)}$ are acquired while the distant sound source is randomly selected, and the set N consisting of the plurality of $N_{t,f}^{(m)}$ is obtained. In addition, various parameters p (e.g., M, F, T, C, B, r, sf1, sf2, and parameters required for learning) are set. S, N, and p obtained by the preprocessing are input to the setting section 111 of the learning device 11 (FIG. 2). The sets S and N are stored in the storage section 112, and various parameters p are set in the individual sections of the learning device 11 (Step S111).

The random sampling section 113 randomly selects the short-distance acoustic signals $\{S_{t,f}^{(0)}, \ldots, S_{t,f}^{(M)}\}$ and the long-distance acoustic signals $(N_{t,f}^{(0)}, \ldots, N_{t,f}^{(M)})$ in T+2C or more time intervals (frames) t ($f \in \{1, \ldots, F\}$) from the sets S and N stored in the storage section 112, performs a simulation in which the observed signals $\{X_{t,f}^{(0)}, \ldots, X_{t,f}^{(M)}\}$ are obtained by superimposing the short-distance acoustic signals on the long-distance acoustic signals, and outputs the obtained observed signals $X_{t,f}^{(m)}$ ($m \in \{0, \ldots, M\}$) (Step S113).

Each observed signal $X_{t,f}^{(m)}$ obtained in Step S113 is input to each down-sampling section 114-*m*. The down-sampling section 114-*m* down-samples the observed signal $X_{t,f}^{(m)}$ to the observed signal $X_{t,f,D}^{(m)}$ having the sampling frequency sf2 (a second acoustic signal derived from signals collected by a plurality of microphones), and outputs the observed signal (Step S114).

The observed signals $X_{t,f,D}^{(0)}, \ldots, X_{t,f,D}^{(M)}$ obtained in Step S114 are input to the function operation section 115. The function operation section 115 obtains the estimated value $\hat{S}_{t,f,D}$ of the short-distance acoustic signal (the estimated value of the short-distance acoustic signal emitted from a position close to a plurality of microphones) from the observed signals $X_{t,f,D}^{(0)}, \ldots, X_{t,f,D}^{(M)}$ according to Formula (2) (a predetermined function), and outputs the estimated value (Step S115).

The observed signal $X_{t,f,D}^{(0)}$ obtained in Step S114 and the estimated value $\hat{S}_{t,f,D}$ of the short-distance acoustic signal obtained in Step S115 are input to the function operation section 116. The function operation section 116 obtains the estimated value $\hat{N}_{t,f,D}$ of the long-distance acoustic signal (the estimated value of the long-distance acoustic signal emitted from a position far from a plurality of microphones) from $X_{t,f,D}^{(0)}$ and $\hat{S}_{t,f,D}$ according to Formula (7), and outputs the estimated value (Step S116).

The estimated value $\hat{S}_{t,f,D}$ of the short-distance acoustic signal obtained in Step S115 and the estimated value $\hat{N}_{t,f,D}$ of the long-distance acoustic signal obtained in Step S116 are input to the feature value calculation section 117. The feature value calculation section 117 calculates the above acoustic feature value $\phi_t$ (the acoustic feature value obtained by associating the value $\hat{s}_{t,D}$ corresponding to the estimated value $\hat{S}_{t,f,D}$ of the short-distance acoustic signal with the value $\hat{n}_{t,D}$ corresponding to the estimated value $\hat{N}_{t,f,D}$ of the long-distance acoustic signal) according to the following Formulas (8), (9), and (10), and outputs the acoustic feature value $\phi_t$ (Step S117).

The acoustic feature value $\phi_t$ obtained in Step S117 and $S_{t,f}^{(0)}$ and $X_{t,f}^{(0)}$ ($t \in \{1, \ldots, T\}$, $f \in \{1, \ldots, F\}$) corresponding to the acoustic feature value $\phi_t$ are input to the learning section 118 as learning data. The learning section 118 learns the parameter $\theta$ (information corresponding to a filter) so as to minimize the function value J(θ) of Formula (12) with the acoustic feature value $\phi_t$, and $S_{t,f}^{(0)}$ and $X_{t,f}^{(0)}$ by using a known learning method. As the learning method, for example, stochastic gradient descent or the like may be appropriately used, and its learning rate may be set to about $10^{-5}$ (Step S118).

The control section 119 performs a convergence determination to determine whether or not a convergence condition has been met. Examples of the convergence condition include a condition that learning has been repeated a specific number of times (e.g., one hundred thousand times), and a condition that the change amount of the parameter θ obtained by each learning has fallen within a specific range. In the case where the control section 119 determines that the convergence condition is not met, the processing returns to the processing in Step S113. On the other hand, in the case where the control section 119 determines that the convergence condition has been met, the learning section 118 outputs the parameter θ which has met the convergence condition. By using this parameter θ and Formula (5), it is possible to obtain the time-frequency masks $G_{t,1}, \ldots, G_{t,F}$ corresponding to the unknown acoustic feature value $\phi_t$ (Step S119).

<Separation Processing>

Figure 5:
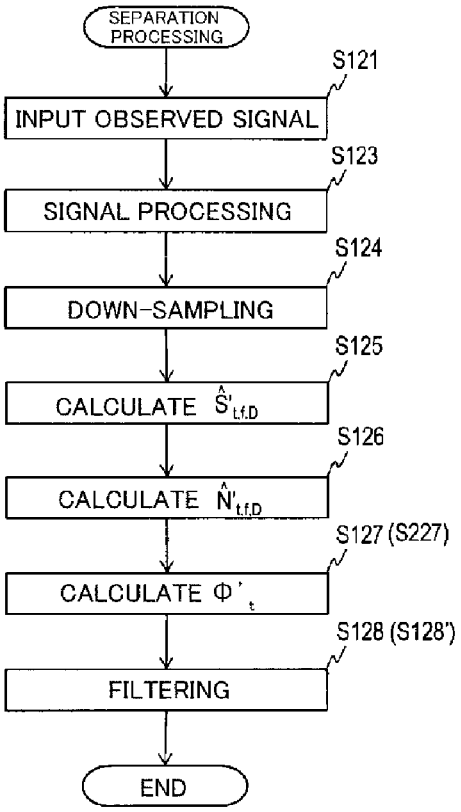
FIG. 5 is a flowchart for explaining separation processing of the embodiment.

Next, by using FIG. 5, separation processing of the present embodiment will be described. As preprocessing, parameters p' (identical to the above parameters p except parameters required for learning) are input to the setting section 121, and the parameter θ output in Step S119 is input to the filter section 128. The parameters p' are set in the individual sections of the acoustic signal separation device 12, and the parameter θ is set in the filter section 128. Thereafter, the following processing is executed for each time interval t.

The sound emitted from a single or a plurality of any sound sources is collected by M+1 (plural) microphones of the spherical microphone array 13, and the signals obtained by the collection are sent to the signal processing section 123 (Step S121). The signal processing section 123 samples the signal acquired by the $m \in \{0, \ldots, M\}$-th microphone with the sampling frequency sf1 and further converts the signal to the signal in the time-frequency domain to obtain the observed signal $X'_{t,f}^{(m)}$ ($m \in \{0, \ldots, M\}$) in the time-frequency domain (a second acoustic signal derived from signals collected by a plurality of microphones), and outputs the observed signal (Step S123).

Each observed signal $X'_{t,f}^{(m)}$ obtained in Step S123 is input to each down-sampling section 124-*m*. The down-sampling section 124-*m* down-samples the observed signal $X'_{t,f}^{(m)}$ to the observed signal $X'_{t,f,D}^{(m)}$ having the sampling frequency sf2 (the second acoustic signal derived from signals collected by a plurality of microphones), and outputs the observed signal (Step S124).

The observed signals $X'_{t,f,D}^{(0)}, \ldots, X'_{t,f,D}^{(M)}$ obtained in Step S124 are input to the function operation section 125. According to

[Formula 18]

$$\hat{S}'_{t,f,D} = X'^{(0)}_{t,f,D} - \sum_{m'=1}^{M} \frac{1}{J_0(kr)} \frac{1}{M} X'^{(m')}_{t,f,D} \tag{15}$$

(a predetermined function), the function operation section 125 obtains the estimated value $\hat{S}'_{t,f,D}$ of the short-distance acoustic signal (the estimated value of the short-distance acoustic signal emitted from the position close to a plurality of microphones) from the observed signals $X'_{t,f,D}^{(0)}, \ldots, X'_{t,f,D}^{(M)}$, and outputs the estimated value. Note that, due to restriction of description and notation, the left side of Formula (15) is written as $\hat{S}'_{t,f,D}$ (Step S125).

The observed signal $X'_{t,f,D}^{(0)}$ obtained in Step S124 and the estimated value $\hat{S}'_{t,f,D}$ of the short-distance acoustic signal obtained in Step S125 are input to the function operation section 126. According to

[Formula 19]

$$\hat{N}'_{t,f,D} = \frac{|X'^{(0)}_{t,f,D}| - |\hat{S}'_{t,f,D}|}{|X'^{(0)}_{t,f,D}|} \cdot X'^{(0)}_{t,f,D}, \tag{16}$$

the function operation section 126 obtains the estimated value $\hat{N}'_{t,f,D}$ of the long-distance acoustic signal (the estimated value of the long-distance acoustic signal emitted from the position far from a plurality of microphones) from $X'_{t,f,D}^{(0)}$ and $\hat{S}'_{t,f,D}$, and outputs the estimated value. Note that, due to restriction of description and notation, the left side of Formula (16) is written as $\hat{N}'_{t,f,D}$ (Step S126).

The estimated value $\hat{S}'_{t,f,D}$ of the short-distance acoustic signal obtained in Step S125 and the estimated value $\hat{N}'_{t,f,D}$ of the long-distance acoustic signal obtained in Step S126 are input to the feature value calculation section 127. According to the following Formulas (17), (18), and (19), the feature value calculation section 127 calculates the acoustic feature value $\phi'_t$ (the acoustic feature value obtained by associating the value $\hat{s}'_{t,D}$ corresponding to the estimated value $\hat{S}'_{t,f,D}$ of the short-distance acoustic signal with the value $\hat{n}'_{t,D}$ corresponding to the estimated value $\hat{N}'_{t,f,D}$ of the long-distance acoustic signal), and outputs the acoustic feature value $\phi'_t$.

$$\varphi'_t = (\hat{s}'_{t-C,D}, \hat{n}'_{1-C,D}, \ldots, \hat{s}'_{t+C,D}, \hat{n}'_{t+C,D})^T \tag{17}$$ [Formula 20]

$$\hat{s}'_{t,D} = \ln(Mel[\mathrm{Abs}[(\hat{S}'_{t,1,D}, \hat{S}'_{t,2,D}, \ldots, \hat{S}'_{t,F,D})]]) \tag{18}$$ [Formula 21]

$$\hat{n}'_{t,D} = \ln(Mel[\mathrm{Abs}[(\hat{N}_{t,1,D}, \hat{N}'_{t,2,D}, \ldots \hat{N}'_{t,F,D})]]) \tag{19}$$ [Formula 22]

Note that, due to restriction of description and notation, the left sides of Formulas (18) and (19) are written as $\hat{s}'_{t,D}$ and $\hat{n}'_{t,D}$, respectively (Step S127).

Each observed signal $X'_{t,f}^{(0)}$ obtained in Step S123 and the acoustic feature value $\phi'_t$ obtained in Step S127 are input to the filter section 128. The filter section 128 calculates the vector $G_t = (G_{t,1}, \ldots, G_{t,F})^T$ obtained by vertically arranging the time-frequency masks $G_{t,1}, \ldots, G_{t,F}$ by using the above-described parameter θ in the following manner:

$$G_t = M(\varphi'_t | \theta) \tag{20}$$ [Formula 23]

Each of the time-frequency masks $G_{t,1}, \ldots, G_{t,F}$ obtained in this manner is a filter (nonlinear filter) obtained by associating the value $\hat{s}_{t,D}$ ($\hat{s}'_{t,D}$) corresponding to the estimated value $\hat{S}_{t,f,D}$ ($\hat{S}'_{t,f,D}$) of the short-distance acoustic signal emitted from the position close to a plurality of microphones with the value $\hat{n}_{t,D}$ ($\hat{n}'_{t,D}$) corresponding to the estimated value $\hat{N}_{t,f,D}$ ($\hat{N}'_{t,f,D}$) of the long-distance acoustic signal emitted from the position far from a plurality of microphones. Further, by using the time-frequency mask $G_{t,f}$ ($f \in \{0, \ldots, F\}$), the filter section 128 acquires the estimated value $\hat{S}_{t,f}$ of the short-distance acoustic signal (a desired acoustic signal representing a sound emitted from a position close to a specific microphone) from the observed signal $X'_{t,f}^{(0)}$ (a first acoustic signal derived from a signal collected by a specific microphone) in the following manner, and outputs the estimated value:

$$\hat{S}'_{t,f}=G_{t,f}X'_{t,f} \quad (21)$$ [Formula 24]

Note that, in the present embodiment, the sampling frequency of the time-frequency mask $G_{t,f}$ is still sf2, and hence, before the calculation of Formula (21) is performed, it is desirable to up-sample the sampling frequency of the time-frequency mask $G_{t,f}$ to the sampling frequency sf1 or the sampling frequency in the vicinity of the sampling frequency sf1 (Step S128). The output $\hat{S}_{t,f}$ may be converted to the signal in the time domain or may also be used in other processing without being converted to the signal in the time domain.

Modification 1 of First Embodiment

In Step S128 in the first embodiment, the filter section 128 of the acoustic signal separation device 12 acquires the estimated value $\hat{S}_{t,f}$ of the short-distance acoustic signal from the observed signal $X'^{(0)}_{t,f}$ by using the time-frequency mask $G_{t,f}$, and outputs the estimated value (Formula (21)). However, the acoustic signal separation device 12 may include a filter section 128' instead of the filter section 128, and the filter section 128' may acquire the estimated value $\hat{N}'_{t,f}$ of the long-distance acoustic signal (the desired acoustic signal representing the sound emitted from the position far from a specific microphone) from the observed signal $X'^{(0)}_{t,f}$ by using the time-frequency mask $G_{t,f}$ in the following manner, and output the estimated value:

$$\hat{N}'_{t,f}=(1-G_{t,f})X'_{t,f} \quad (22)$$ [Formula 25]

Alternatively, the acoustic signal separation device 12 may include the filter section 128' in addition to the filter section 128, the filter section 128 may acquire the estimated value $\hat{S}_{t,f}$ of the short-distance acoustic signal according to Formula (21) as described above, and output the estimated value, and the filter section 128' may acquire the estimated value $\hat{N}'_{t,f}$ of the long-distance acoustic signal according to Formula (22) as described above, and output the estimated value. Alternatively, it may be possible to select, based on the input, the acquisition and outputting of the estimated value $\hat{S}'_{t,f}$ of the distance acoustic signal by the filter section 128 or the acquisition and outputting of the estimated value $\hat{N}'_{t,f}$ of the long-distance acoustic signal by the filter section 128' (Step S128').

Modification 2 of First Embodiment

In Step S118 in the first embodiment, the learning section 118 of the learning device 11 learns the parameter θ (information corresponding to the filter) so as to minimize the function value J(θ) of Formula (12). However, the learning device 11 may include a learning section 118" instead of the learning section 118, and the learning section 118" may use the acoustic feature value $\phi_t$ obtained in Step S117, and $N^{(0)}_{t,f}$ and $X^{(0)}_{t,f}$ ($t\in\{1, \ldots, T\}$, $f\in\{1, \ldots, F\}$) corresponding to the acoustic feature value $\phi_t$ as learning data, and learn the parameter θ (information corresponding to the filter) so as to minimize the function value J(θ) by using a known learning method in the following manner (Step S118"):

[Formula 26]

$$J(\Theta)=\sum_{t=1}^{T}\|N_t^{(0)}-M(\varphi_t\mid\Theta)\circ X_t^{(0)}\|_2 \quad (23)$$

[Formula 27]

$$N_t^{(0)}=(N_{t,1}^{(0)}, \ldots, N_{t,F}^{(0)})^T \quad (24)$$

In this case, the filter section 128 of the acoustic signal separation device 12 may acquire the estimated value $\hat{N}'_{t,f}$ of the long-distance acoustic signal from the observed signal $X'^{(0)}_{t,f}$ by using the time-frequency mask $G_{t,f}$ in the following manner and output the estimated value:

$$\hat{N}'_{t,f}=G_{t,f}X'_{t,f} \quad (25)$$ [Formula 28]

Alternatively, the filter section 128' of the acoustic signal separation device 12 may acquire the estimated value $\hat{S}'_{t,f}$ of the short-distance acoustic signal from the observed signal $X'^{(0)}_{t,f}$ by using the time-frequency mask $G_{t,f}$ in the following manner and output the estimated value:

$$\hat{S}'_{t,f}=(1-G_{t,f})X'_{t,f} \quad (26)$$ [Formula 29]

Alternatively, the acoustic signal separation device 12 may include the filter section 128' in addition to the filter section 128, the filter section 128 may acquire the estimated value $\hat{N}'_{t,f}$ of the long-distance acoustic signal according to Formula (25) as described above and output the estimated value, and the filter section 128' may acquire the estimated value $\hat{S}'_{t,f}$ of the short-distance acoustic signal according to Formula (26) as described above and output the estimated value. Alternatively, it may be possible to select, based on the input, the acquisition and outputting of the estimated value $\hat{N}'_{t,f}$ of the long-distance acoustic signal by the filter section 128 or the acquisition and outputting of the estimated value $\hat{S}'_{t,f}$ of the short-distance acoustic signal by the filter section 128'.

Second Embodiment

A second embodiment will be described. The present embodiment is a modification of the first embodiment, and is different from the first embodiment only in that up-sampling is performed before the calculation of the acoustic feature value. In the following description, points different from the first embodiment will be mainly described, and the description of matters common to the first embodiment will be simplified by using the same reference numerals.

<Configuration>

As illustrated in FIG. 1, an acoustic signal separation system 2 of the present embodiment has a learning device 21, an acoustic signal separation device 22, and the spherical microphone array 13.

«Learning Device 21»

As illustrated in FIG. 2, the learning device 21 of the present embodiment has the setting section 111, the storage section 112, the random sampling section 113, the down-sampling sections **114-*m* ($m\in\{0, \ldots, M\}$), the function operation sections 115 and 116, a feature value calculation section 217, the learning section 118, and the control section 119**.

«Acoustic Signal Separation Device 22»

As illustrated in FIG. 3, the acoustic signal separation device 22 of the present embodiment has the setting section 121, the signal processing section 123, the down-sampling sections **124-*m* ($m\in\{0, \ldots, M\}$), the function operation sections 125 and 126, a feature value calculation section 227, and the filter section 128**.

<Learning Processing>

Next, learning processing of the present embodiment will be described by using FIG. 4. The learning processing of the present embodiment is different from the learning processing of the first embodiment only in that Step S117 is replaced with Step S217 described below. The other points of the learning processing are the same as those of the learning processing of the first embodiment, Modification 1 of the first embodiment, or Modification 2 of the first embodiment.

«Step S217»

The estimated value $\hat{S}_{t,f,D}$ of the short-distance acoustic signal obtained in Step S115 and the estimated value $\hat{N}_{t,f,D}$ of the long-distance acoustic signal obtained in Step S116 are input to the feature value calculation section 217. The feature value calculation section 217 up-samples $\hat{S}_{t,f,D}$ and $\hat{N}_{t,f,D}$ to $\hat{S}_{t,f}$ and $\hat{N}_{t,f}$ each having the sampling frequency sf1. Thereafter, in up-sampled states, the feature value calculation section 217 calculates $\hat{s}_t$ and $\hat{n}_t$ instead of $\hat{s}_{t,D}$ and $\hat{n}_{t,D}$ according to Formulas (9) and (10) by using $\hat{S}_{t,f}$ and $\hat{N}_{t,f}$ instead of $\hat{S}_{t,f,D}$ and $\hat{N}_{t,f,D}$. Further, the feature value calculation section 217 obtains $\hat{s}_{t,L}$ by extracting only an element in a frequency band equal to or lower than the Nyquist frequency from $\hat{s}_t$, and obtains $\hat{n}_{t,L}$ by extracting only an element in a frequency band equal to or lower than the Nyquist frequency from $\hat{n}_t$. The feature value calculation section 217 calculates the acoustic feature value $\phi_t$ (the acoustic feature value obtained by associating the value $\hat{s}_{t,L}$ corresponding to the estimated value $\hat{S}_{t,f,D}$ of the short-distance acoustic signal with the value $\hat{n}_{t,L}$ corresponding to the estimated value $\hat{N}_{t,f,D}$ of the long-distance acoustic signal) according to Formula (8) by using $\hat{s}_{t,L}$ and $\hat{n}_{t,L}$ instead of $\hat{s}_{t,D}$ and $\hat{n}_{t,D}$, and outputs the acoustic feature value $\phi_t$.

<Separation Processing>

Next, separation processing of the present embodiment will be described by using FIG. 5. The separation processing of the present embodiment is different from the separation processing of the first embodiment only in that Step S127 is replaced with Step S227 described below. The other points of the separation processing are the same as those of the separation processing of the first embodiment.

«Step S227»

The estimated value $\hat{S}'_{t,f,D}$ of the short-distance acoustic signal obtained in Step S125 and the estimated value $\hat{N}'_{t,f,D}$ of the long-distance acoustic signal obtained in Step S126 are input to the feature value calculation section 227. The feature value calculation section 227 up-samples $\hat{S}'_{t,f,D}$ and $\hat{N}'_{t,f,D}$ to $\hat{S}'_{t,f}$ and $\hat{N}'_{t,f}$ each having the sampling frequency sf1. Thereafter, in up-sampled states, the feature value calculation section 227 calculates $\hat{s}'_t$ and $\hat{n}'_t$ instead of $\hat{s}'_{t,D}$ and $\hat{n}'_{t,D}$ according to Formulas (18) and (10) by using $\hat{S}'_{t,f}$ and $\hat{N}'_{t,f}$ instead of $\hat{S}'_{t,f,D}$ and $\hat{N}'_{t,f,D}$. Further, the feature value calculation section 227 obtains $\hat{s}'_{t,L}$ by extracting only an element in a frequency band equal to or lower than the Nyquist frequency from $\hat{s}'_t$, and obtains $\hat{n}'_{t,L}$ by extracting only an element in a frequency band equal to or lower than the Nyquist frequency from $\hat{n}'_t$. The feature value calculation section 227 calculates the acoustic feature value $\phi'_t$ (the acoustic feature value obtained by associating the value $\hat{s}'_{t,L}$ corresponding to the estimated value $\hat{S}'_{t,f,D}$ of the short-distance acoustic signal with the value $\hat{n}'_{t,L}$ corresponding to the estimated value $\hat{N}'_{t,f,D}$ of the long-distance acoustic signal) according to Formula (17) by using $\hat{n}'_{t,L}$ and $\hat{n}'_{t,L}$ instead of $\hat{s}'_{t,D}$ and $\hat{n}'_{t,D}$, and outputs the acoustic feature value $\phi'_t$.

SUMMARY

The learning device of each of the first and second embodiments and the modifications thereof uses the learning data (the acoustic feature value $\phi_t$) in which the value corresponding to the estimated value $\hat{S}_{t,f,D}$ of the short-distance acoustic signal which is obtained by using "the predetermined function" (Formula (2)) from the second acoustic signal (the observed signal $X_{t,f,D}^{(m)}$) derived from the signals collected by "the plurality of microphones" and is emitted from the position close to "the plurality of microphones" is associated with the value corresponding to the estimated value $\hat{N}_{t,f,D}$ of the long-distance acoustic signal which is emitted from the position far from "the plurality of microphone", and learns the information (the parameter θ) corresponding to the filter (the time-frequency masks $G_{t,1}, \ldots, G_{t,F}$) for separating the desired acoustic signal representing at least one of the sound emitted from the position close to "the specific microphone" and the sound emitted from the position far from the specific microphone from the first acoustic signal (the observed signal $X'^{(0)}_{t,f}$) derived from the signal collected by "the specific microphone". Note that the distance represented by the expression "close to the microphone" is shorter than the distance represented by the expression "far from the microphone". For example, the distance represented by the expression "close to the microphone" is a distance of 30 cm or less, and the distance represented by the expression "far from the microphone" is a distance of 1 m or more. For example, the estimated value $\hat{S}_{t,f,D}$ of the short-distance acoustic signal is obtained by using the second acoustic signal and "the predetermined function" (Formula (2)), and the estimated value $\hat{N}_{t,f,D}$ of the long-distance acoustic signal is obtained by using the second acoustic signal and the estimated value $\hat{S}_{t,f,D}$ of the short-distance acoustic signal (Formula (7)).

In addition, in the acoustic signal separation device for separating the desired acoustic signal from the first acoustic signal (the observed signal $X'^{(0)}_{t,f}$), by using the filter (the time-frequency masks $G_{t,1}, \ldots, G_{t,F}$ serving as the filter based on the information obtained by the learning which uses the learning data in which the value corresponding to the estimated value of the short-distance acoustic signal is associated with the value corresponding to the estimated value of the long-distance acoustic signal) which is obtained by associating the value corresponding to the estimated value ($\hat{S}_{t,f,D}$, $\hat{S}'_{t,f,D}$) of the short-distance acoustic signal which is obtained by using "the predetermined function" from the second acoustic signal (the observed signal $X_{t,f,D}^{(m)}$, $X'^{(0)}_{t,f}$) derived from the signals collected by "the plurality of microphones" and is emitted from the position close to "the plurality of microphones" with the value corresponding to the estimated value ($\hat{N}_{t,f,D}$, $\hat{N}'_{t,f,D}$) of the long-distance acoustic signal which is emitted from the position far from the plurality of microphone, the desired acoustic signal ($\hat{S}'_{t,f}$ and/or $\hat{N}'_{t,f}$) representing at least one of the sound emitted from the position close to "the specific microphone" and the sound emitted from the position far from "the specific microphone" is acquired from the first acoustic signal (the observed signal $X'^{(0)}_{t,f}$) derived from the signal collected by "the specific microphone".

As described above, the number of dimensions of the acoustic feature value $\phi_t$ used as the learning data in each embodiment is obtained by associating the value corresponding to the estimated value $\hat{S}_{t,f,D}$ of the short-distance acoustic signal with the value corresponding to the estimated value $\hat{N}_{t,f,D}$ of the long-distance acoustic signal, and corresponds to two channels consisting of $\hat{S}_{t,f,D}$ and $\hat{N}_{t,f,D}$ irrespective of the number of microphones M+1. Consequently, in each embodiment, as compared with the case where the observed signals by the microphones M+1 are used as the learning data without being altered, it is possible to significantly reduce the number of dimensions of the learning data. As a result, as compared with the case where the observed signals by the microphones M+1 are used as the learning data without being altered, it is possible to reduce the data amount of the learning data and significantly reduce the amount of learning time. The acoustic feature value $\phi_t$ is obtained by using "the predetermined function", and "the predetermined function" is the function which uses such an approximation that the sound emitted from the position close to "the plurality of microphones" is collected by "the plurality of microphones" as the spherical wave and the sound emitted from the position far from "the plurality of microphones" is collected by "the plurality of microphones" as the plane wave. The acoustic feature value $\phi_t$ obtained in this manner includes the clue for distinguishing between the short-distance acoustic signal and the long-distance acoustic signal, and has the large mutual information amount with $G_t=(G_{t,1}, \ldots, G_{t,F})$. Accordingly, by using such an acoustic feature value $\phi_t$ as the learning data, it is possible to estimate the filter (the time-frequency masks $G_{t,1}, \ldots, G_{t,F}$) with high accuracy and separate the acoustic signal with high accuracy based on the difference in the distance from the sound source to the microphone. In addition, although only the acoustic feature value in the low frequency band can be used in the learning of the filter (the time-frequency masks $G_{t,1}, \ldots, G_{t,F}$), it is possible to use the filter obtained by the learning in the high frequency band. Accordingly, it is also possible to use the acoustic signal separation obtained by using such a filter as preprocessing of an application which handles the acoustic signal in voice recognition or the like.

The sampling frequency of the first acoustic signal (the observed signal $X'^{(0)}_{t,f}$) is sf1 (the first frequency), the sampling frequency of the second acoustic signal (the observed signal $X_{t,f,D}^{(m)}$) is sf2 (the second frequency), and sf2 (the second frequency) is lower than sf1 (the first frequency). In each of the second embodiment and its modification, while the sampling frequency of each of the estimated value $\hat{S}_{t,f,D}$ of the short-distance acoustic signal and the estimated value $\hat{N}_{t,f,D}$ of the long-distance acoustic signal is sf2 (the second frequency), the sampling frequency of each of the value corresponding to the estimated value $\hat{S}_{t,f,D}$ of the short-distance acoustic signal and the value corresponding to the estimated value $\hat{N}_{t,f,D}$ of the long-distance acoustic signal is up-sampled to sf1 (the first frequency). Consequently, it is possible to cause the sampling frequency of the filter (the time-frequency masks $G_{t,1}, \ldots, G_{t,F}$) obtained based on the learning to coincide with that of the first acoustic signal (the observed signal $X'^{(0)}_{t,f}$), and simplify filtering processing. Note that the sampling frequency of each of the estimated value $\hat{S}_{t,f,D}$ of the short-distance acoustic signal and the estimated value $\hat{N}_{t,f,D}$ of the long-distance acoustic signal may be in the vicinity of sf2 (the second frequency), and the sampling frequency of each of the value corresponding to the estimated value $\hat{S}_{t,f,D}$ of the short-distance acoustic signal and the value corresponding to the estimated value $\hat{N}_{t,f,D}$ of the long-distance acoustic signal may be up-sampled to a frequency in the vicinity of sf1 (the first frequency).

Note that the present invention is not limited to the above-described embodiments. For example, learning and application of the filter may be performed by using a model other than DNN. In addition, a single device including the function of the learning device and the function of the acoustic signal separation device may also be provided. The above-described various processing may be executed in parallel or individually depending on the processing capability of a device which executes the processing or on an as needed basis as well as being executed time-sequentially according to the description. In addition, it will be easily appreciated that the present invention can be changed appropriately without departing from the spirit of the present invention.

A general-purpose or dedicated computer including, e.g., a processor (hardware processor) such as a CPU (central processing unit) and a memory such as a RAM (random-access memory) or a ROM (read-only memory) executes a predetermined program, and each device described above is thereby constituted. The computer may include one processor and one memory, or may also include a plurality of processors and a plurality of memories. The program may be installed in the computer or may also be recorded in the ROM or the like in advance. In addition, part or all of processing sections may be constituted by using electronic circuitry which implements processing functions without using the program instead of electronic circuitry which implements processing functions by reading the program such as the CPU. Electronic circuitry constituting one device may include a plurality of CPUs.

In the case where the above-described configuration is implemented by a computer, the processing contents of the functions of the individual devices are described using a program. By executing the program with the computer, the above processing functions are implemented on the computer. The program in which the processing contents are described can be recorded in a computer-readable recording medium. An example of the computer-readable recording medium includes a non-transitory recording medium. Examples of such a recording medium include a magnetic recording device, an optical disk, a magneto-optical recording medium, and a semiconductor memory.

Distribution of the program is performed by selling, transferring, or lending a portable recording medium such as a DVD or a CD-ROM in which the program is recorded. Further, the program may be stored in a storage device of a server computer in advance, and the program may be distributed by transferring the program from the server computer to another computer via a network.

First, for example, the computer which executes such a program temporarily stores the program recorded in the portable recording medium or the program transferred from the server computer in a storage device of the computer. When processing is executed, the computer reads the program stored in its storage device, and executes the processing corresponding to the read program. As another execution mode of the program, the computer may read the program directly from the portable recording medium and execute the processing corresponding to the program. Further, every time the program is transferred to the computer from the server computer, the computer may execute the processing corresponding to the received program. A configuration may also be adopted in which the above processing is executed by what is called an ASP (Application Service Provider)-type service in which the transfer of the program to the computer from the server computer is not performed and the processing functions are implemented only by execution instructions and result acquisition.

Instead of implementing the processing functions of the present devices by causing the predetermined program to be executed on the computer, at least part of the processing functions may be implemented by hardware.

INDUSTRIAL APPLICABILITY

For example, in the case where the above-described technique for separating the sound emitted from the position far from the microphone is applied to a smart speaker or the like, even when the smart speaker or the like is placed at the side of a television set, it is possible to suppress the sound of the television set to clearly extract a distant sound or the like, and it is possible to improve the quality of voice recognition and a call.

For example, in the case where the above-described technique for separating the sound emitted from the position close to the microphone is applied to an abnormal sound detection device in a factory, and the abnormal sound detection device is disposed at the side of target equipment to be monitored, it becomes possible to suppress noise coming from another section to extract only the sound of the target equipment to be monitored, and it is possible to improve detection accuracy by the abnormal sound detection device.

REFERENCE SIGNS LIST

1 Acoustic signal separation system
11, 21 Learning device
12, 22 Acoustic signal separation device

The invention claimed is:

1. An acoustic signal separation device for separating a desired acoustic signal from a first acoustic signal, the device comprising:

a filter obtained by associating a value corresponding to an estimated value of a short-distance acoustic signal, wherein the short-distance acoustic signal is obtained by using a predetermined function from a second acoustic signal derived from signals collected by a plurality of microphones including microphones positioned along a spherical surface of a sphere and is emitted from a position in proximity to the plurality of microphones with a value corresponding to an estimated value of a long-distance acoustic signal, wherein the long-distance acoustic signal is emitted from a position far from the plurality of microphones; and the filter configured to acquire, from the first acoustic signal derived from a signal collected by a specific microphone, the desired acoustic signal representing at least one of a sound emitted from a position in proximity to the specific microphone and a sound emitted from a position far from the specific microphone, wherein the predetermined function is a function which uses such an approximation of:

a sound emitted from the position close to the plurality of microphones is collected by the plurality of microphones as a spherical wave, and a sound emitted from the position far from the plurality of microphones is collected by the plurality of microphones as a plane wave.

2. The acoustic signal separation device according to claim 1, wherein the estimated value of the short-distance acoustic signal is obtained by using the second acoustic signal and the predetermined function, and the estimated value of the long-distance acoustic signal is obtained by using the second acoustic signal and the estimated value of the short-distance acoustic signal.

3. The acoustic signal separation device according to claim 1, wherein a sampling frequency of the first acoustic signal is a first frequency, wherein a sampling frequency of the second acoustic signal is a second frequency, wherein the second frequency is lower than the first frequency, wherein a sampling frequency of each of the estimated value of the short-distance acoustic signal and the estimated value of the long-distance acoustic signal is equal to the second frequency or in the vicinity of the second frequency, and wherein a sampling frequency of each of the value corresponding to the estimated value of the short-distance acoustic signal and the value corresponding to the estimated value of the long-distance acoustic signal is equal to the first frequency or in the vicinity of the first frequency.

4. The acoustic signal separation device according to claim 1, wherein the filter is based on information obtained by learning which uses learning data in which the value corresponding to the estimated value of the short-distance acoustic signal is associated with the value corresponding to the estimated value of the long-distance acoustic signal.

5. The acoustic signal separation device according to claim 2, wherein a sampling frequency of the first acoustic signal is a first frequency, wherein a sampling frequency of the second acoustic signal is a second frequency, wherein the second frequency is lower than the first frequency, wherein a sampling frequency of each of the estimated value of the short-distance acoustic signal and the estimated value of the long-distance acoustic signal is equal to the second frequency or in the vicinity of the second frequency, and wherein a sampling frequency of each of the value corresponding to the estimated value of the short-distance acoustic signal and the value corresponding to the estimated value of the long-distance acoustic signal is equal to the first frequency or in the vicinity of the first frequency.

6. The acoustic signal separation device according to claim 2, wherein the filter is based on information obtained by learning which uses learning data in which the value corresponding to the estimated value of the short-distance acoustic signal is associated with the value corresponding to the estimated value of the long-distance acoustic signal.

7. The acoustic signal separation device according to claim 3, wherein the filter is based on information obtained by learning which uses learning data in which the value corresponding to the estimated value of the short-distance acoustic signal is associated with the value corresponding to the estimated value of the long-distance acoustic signal.

8. A computer-implemented acoustic signal separation method for separating a desired acoustic signal from a first acoustic signal, the method comprising:

creating a filter by associating a value corresponding to an estimated value of a short-distance acoustic signal, wherein the short-distance acoustic signal is obtained by using a predetermined function from a second acoustic signal derived from signals collected by a plurality of microphones including microphones positioned along a spherical surface of a sphere and is emitted from a position close to the plurality of microphones with a value corresponding to an estimated value of a long-distance acoustic signal which is emitted from a position far from the plurality of microphones; and acquiring, by the filter, the first acoustic signal derived from a signal collected by a specific microphone positioned inside the sphere, the desired acoustic signal representing at least one of a sound emitted from a position in proximity to the specific microphone and a sound emitted from a position far from the specific microphone, wherein the predetermined function is a function which uses such an approximation that a sound emitted from the position in proximity to the plurality of microphones is collected by the plurality of microphones as a spherical wave, and a sound emitted from the position far from the plurality of microphones is collected by the plurality of microphones as a plane wave.

9. The computer-implemented acoustic signal separation method of claim 8, the method further comprising:

receiving learning data comprising the value corresponding to the estimated value of a short-distance acoustic signal and the value corresponding to the estimated value of a long-distance acoustic signal which is emitted from a position far from the plurality of microphones.

10. The computer-implemented acoustic signal separation method of claim 8, wherein the estimated value of the short-distance acoustic signal is obtained by using the second acoustic signal and the predetermined function, and the estimated value of the long-distance acoustic signal is obtained by using the second acoustic signal and the estimated value of the short-distance acoustic signal.

11. The computer-implemented acoustic signal separation method of claim 10, wherein a sampling frequency of the first acoustic signal is a first frequency, wherein a sampling frequency of the second acoustic signal is a second frequency, wherein the second frequency is lower than the first frequency, wherein a sampling frequency of each of the estimated value of the short-distance acoustic signal and the estimated value of the long-distance acoustic signal is equal to the second frequency or in the vicinity of the second frequency, and wherein a sampling frequency of each of the value corresponding to the estimated value of the short-distance acoustic signal and the value corresponding to the estimated value of the long-distance acoustic signal is equal to the first frequency or in the vicinity of the first frequency.

12. The computer-implemented acoustic signal separation method of claim 8, wherein a sampling frequency of the first acoustic signal is a first frequency, wherein a sampling frequency of the second acoustic signal is a second frequency, wherein the second frequency is lower than the first frequency, wherein a sampling frequency of each of the estimated value of the short-distance acoustic signal and the estimated value of the long-distance acoustic signal is equal to the second frequency or in the vicinity of the second frequency, and wherein a sampling frequency of each of the value corresponding to the estimated value of the short-distance acoustic signal and the value corresponding to the estimated value of the long-distance acoustic signal is equal to the first frequency or in the vicinity of the first frequency.

13. The computer-implemented acoustic signal separation method of claim 10, wherein the filter is based on information obtained by learning which uses learning data in which the value corresponding to the estimated value of the short-distance acoustic signal is associated with the value corresponding to the estimated value of the long-distance acoustic signal.

14. The computer-implemented acoustic signal separation method of claim 8, wherein the filter is based on information obtained by learning which uses learning data in which the value corresponding to the estimated value of the short-distance acoustic signal is associated with the value corresponding to the estimated value of the long-distance acoustic signal.

15. The computer-implemented acoustic signal separation method of claim 12, wherein the filter is based on information obtained by learning which uses learning data in which the value corresponding to the estimated value of the short-distance acoustic signal is associated with the value corresponding to the estimated value of the long-distance acoustic signal.

16. A computer-readable non-transitory recording medium storing computer-executable program instructions that when executed by a processor cause a computer system to function as the acoustic signal separation device, the device comprising:

a filter obtained by associating a value corresponding to an estimated value of a short-distance acoustic signal, wherein the short-distance acoustic signal is obtained by using a predetermined function from a second acoustic signal derived from signals collected by a plurality of microphones including microphones positioned along a spherical surface of a sphere and is emitted from a position in proximity to the plurality of microphones with a value corresponding to an estimated value of a long-distance acoustic signal, wherein the long-distance acoustic signal is emitted from a position far from the plurality of microphones; and the filter configured to acquire, from the first acoustic signal derived from a signal collected by a specific microphone positioned inside the sphere, the desired acoustic signal representing at least one of a sound emitted from a position in proximity to the specific microphone and a sound emitted from a position far from the specific microphone, wherein the predetermined function is a function which uses such an approximation of:

a sound emitted from the position close to the plurality of microphones is collected by the plurality of microphones as a spherical wave, and a sound emitted from the position far from the plurality of microphones is collected by the plurality of microphones as a plane wave.

17. The computer-readable non-transitory recording medium of claim 16, wherein the estimated value of the short-distance acoustic signal is obtained by using the second acoustic signal and the predetermined function, and the estimated value of the long-distance acoustic signal is obtained by using the second acoustic signal and the estimated value of the short-distance acoustic signal.

18. The computer-readable non-transitory recording medium of claim 16, wherein a sampling frequency of the first acoustic signal is a first frequency, wherein a sampling frequency of the second acoustic signal is a second frequency, wherein the second frequency is lower than the first frequency, wherein a sampling frequency of each of the estimated value of the short-distance acoustic signal and the estimated value of the long-distance acoustic signal is equal to the second frequency or in the vicinity of the second frequency, and wherein a sampling frequency of each of the value corresponding to the estimated value of the short-distance acoustic signal and the value corresponding to the estimated value of the long-distance acoustic signal is equal to the first frequency or in the vicinity of the first frequency.

19. The computer-readable non-transitory recording medium of claim 18, wherein the filter is based on information obtained by learning which uses learning data in which the value corresponding to the estimated value of the short-distance acoustic signal is associated with the value corresponding to the estimated value of the long-distance acoustic signal.

* * * * *